United States Patent [19]

Renfro

[11] Patent Number: 4,662,437

[45] Date of Patent: May 5, 1987

[54] ELECTRICALLY STIMULATED WELL PRODUCTION SYSTEM WITH FLEXIBLE TUBING CONDUCTOR

[75] Inventor: Jimmie J. Renfro, Plano, Tex.

[73] Assignee: Atlantic Richfield Company, Los Angeles, Calif.

[21] Appl. No.: 797,739

[22] Filed: Nov. 14, 1985

[51] Int. Cl.[4] ..... E21B 43/00

[52] U.S. Cl. ..... 166/65.1; 166/248

[58] Field of Search ..... 166/62, 65.1, 248, 302

[56] References Cited

U.S. PATENT DOCUMENTS

| | | | |
|---|---|---|---|
| 2,362,680 | 11/1944 | Troupe | 166/62 |
| 4,071,278 | 1/1978 | Carpenter et al. | 166/65.1 |
| 4,476,923 | 10/1984 | Walling | 166/65.1 |
| 4,484,627 | 11/1984 | Perkins | 166/65.1 |
| 4,487,257 | 12/1984 | Dauphiné | 166/65.1 |
| 4,567,945 | 2/1986 | Segalman | 166/65.1 |

*Primary Examiner*—Stephen J. Novosad
*Assistant Examiner*—William P. Neuder
*Attorney, Agent, or Firm*—Michael E. Martin

[57] ABSTRACT

Electrical resistance heating of subterranean viscous fluid deposits is provided by a wellbore having a conductive casing section and a coupling disposed in proximity to the formation. An elongated, flexible fluid injection or withdrawal tube extends into the wellbore, is secured to the coupling, and is connected to a source of electrical energy. The tube is preferably of composite construction having an inner steel core, an outer copper layer and a reinforced plastic corrosion resistant coating over the copper layer.

15 Claims, 4 Drawing Figures

ELECTRICALLY STIMULATED WELL PRODUCTION SYSTEM WITH FLEXIBLE TUBING CONDUCTOR

BACKGROUND OF THE INVENTION

1. Field of the Invention

The present invention pertains to a hydrocarbon fluid well production system wherein electrical power is used to enhance the production of fluids through resistance heating of the fluid bearing formation, and wherein a unique, flexible, coiled tubing is used as an electrical conductor.

2. Background

It has been proposed to produce certain subterranean deposits of viscous hydrocarbonaceous substances by passing an electrical current through the formation to be produced whereby electrical resistance heating renders the viscous hydrocarbons more flowable. U.S. Pat. No. 4,484,627 to Thomas K. Perkins and assigned to the assignee of the present invention, proposes the construction of a well wherein a metallic casing is used as an electrical conductor and as one of the spaced-apart electrodes required in the electrical circuit for enhancing the flow of subterranean hydrocarbon deposits.

Although the system disclosed in the Perkins Patent is directed to overcoming the power losses associated with the use of magnetic casing materials, the well structure is relatively complicated and the non-magnetic metals suitable for casing type conductors are susceptible to rapid rates of corrosion and are relatively expensive to manufacture and install. Moreover, the location of some viscous hydrocarbon deposits, such as in arctic regions, require that essentially no heating of the casing structure be tolerated so as to restrict melting of the permafrost layer of earth and the detrimental effects of same.

Another prior art arrangement of providing downhole electrical power transmission includes running conventional electrical conductors inside the wellbore. The small size of the electrical cable required to be run in the space available in a cased and completed wellbore increases both the system power loss and heat generated in the wellbore itself. Yet another problem associated with such prior art methods includes the relatively slow and cumbersome procedure required when installing conventional electrical conductors in the wellbore, thus increasing the overall well completion costs.

The completion of a cased wellbore using non-metallic casing such as fiberglass or other composite structures has also been proposed. However, presently available non-metallic casing and tubular members are rated at temperatures in the range of approximately 250° F. Production from many wells, considering the wellbore depth and the heat generated by electrical heating may produce fluid temperatures of fluids entering the wellbore in the range of about 400° F.

Accordingly, there have been several problems associated with the development of wells utilizing electrical power transmission to stimulate fluid production that have required or deserve solution in order to improve the viability of this method of enhanced hydrocarbon recovery processes.

SUMMARY OF THE INVENTION

The present invention provides an improved well system for producing subterranean deposits of viscous hydrocarbons wherein the flowability of hydrocarbon fluids is increased by heating the fluid in the formation through the conversion of electric power. In accordance with one aspect of the invention, there is provided a well system for producing hydrocarbon fluids and the like wherein a fluid conducting tube is utilized as an electrical power conductor. The present invention also provides a unique electrical conductor arrangement for a wellbore wherein electrical power loss and unwanted heat generation are minimized.

In accordance with an important aspect of the invention, a subterranean well is provided wherein electric power is conducted down the wellbore into the immediate vicinity of the formation to be produced by utilizing a unique flexible fluid conducting tube as an electrical conductor for transmission of electric energy to a portion of the well casing or other conductive element in a way which will minimize power losses and unwanted heat generation in the upper regions of the wellbore.

In accordance with another important aspect of the present invention, there is provided an arrangement of a fluid injection well wherein the fluid injection tubing is utilized also as an electrical conductor for transmitting electric power to an electrode in the wellbore for transmission through a selected subterranean formation. In the arrangement of either a producing well or an injection well, transmission of electric current is obtained through a unique coupling arrangement between a flexible tubing and a well casing member and the conductive path is further provided by a unique casing structure.

Still further, in accordance with the present invention, there is provided a composite flexible tubing member which serves as a fluid conduit, an electrical conductor, and is insulated from the adverse effects of corrosive fluids and the like.

Those skilled in the art will further appreciate the abovementioned advantages and features of the present invention, as well as additional superior aspects thereof upon reading the detailed description which follows in conjunction with the drawing.

DESCRIPTION OF THE PREFERRED EMBODIMENTS

Figure 1:
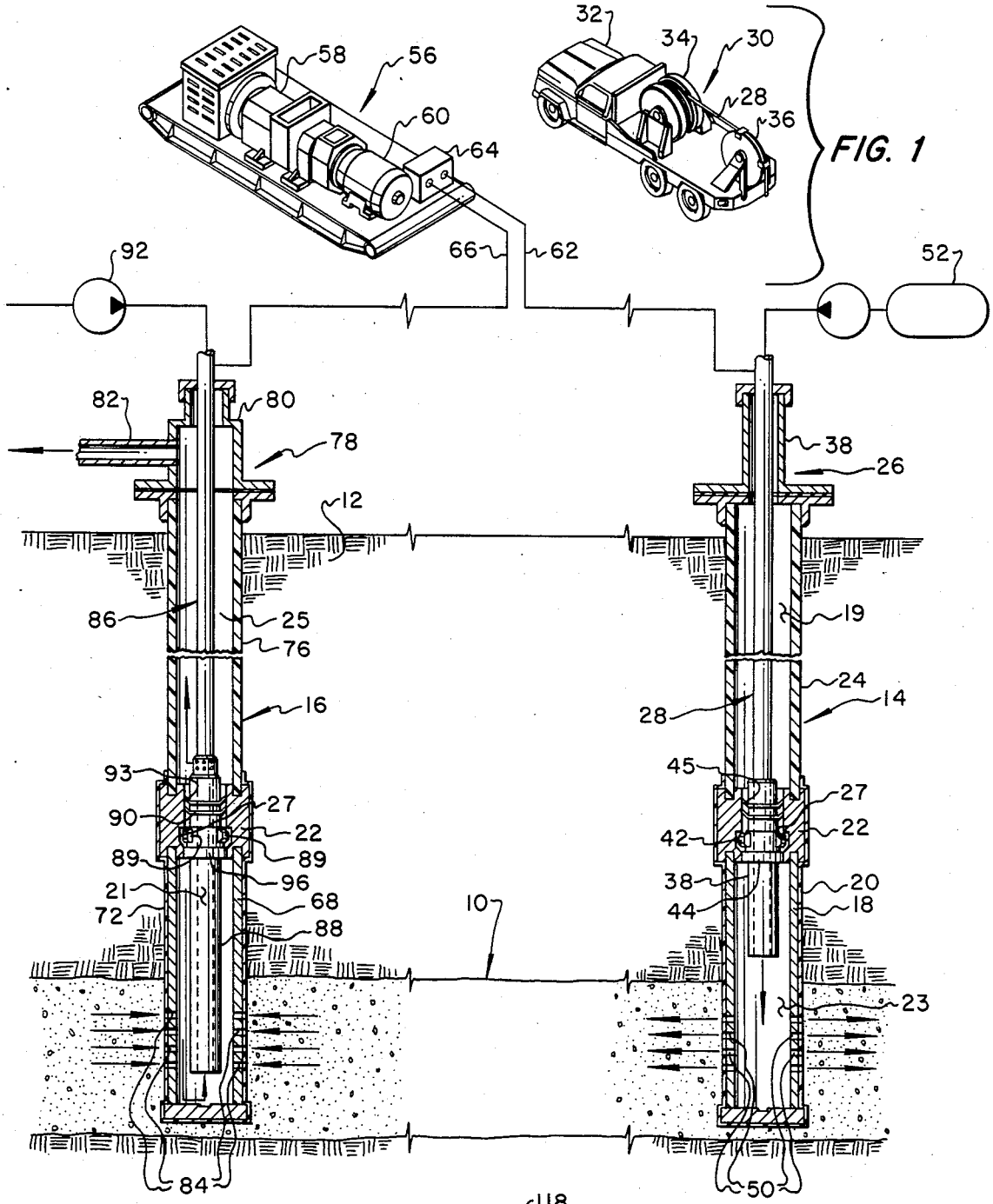
FIG. 1 is an elevation, in section and in somewhat schematic form, of a sytem for producing viscous hydrocarbon fluids utilizing electrical heating in accordance with the present invention.

In the description which follows, like parts are marked throughout the specification and drawing with the same reference numerals, respectively. The drawing figures are not necessarily to scale and certain features of the invention may be shown exaggerated in scale or in somewhat schematic form in the interest of clarity and conciseness.

Referring to FIG. 1, there is illustrated a system for producing liquid, relatively viscous, hydrocarbons from a subterranean formation generally designated by the numeral 10. The formation 10 may be one of a type known to exist such as those designated as the West Sak and Ugnu Formations in Alaska. These formations are found at depths ranging form 3000 to 4000 feet below the earth's surface and contain hydrocarbons having an API gravity in the range of 11° to 16°. The abovementioned formations also lie below a layer of permafrost 12 which may range up to 2000 feet thick. In accordance with the present invention, it is contemplaated to provide spaced-apart wells, 14 and 16, which may be arranged in various patterns and may be combinations of injection and producing wells, as indicated in FIG. 1, respectively, or combinations of both wells being producing wells or both wells being injection wells, in accordance with the present invention.

Each of the wells 14 and 16 is constructed in accordance with a unique arrangement of nonconductive and conductive casing. For example, referring to the well 14, a lower conductive section of casing 18 is provided which is preferably of a conventional conductive metal such as steel. The casing section 18 may, for example, be in the range of approximately 200 to 300 feet in length and provided with a layer of suitable electrical insulation 20 on the exterior thereof. The well 14 also includes an annular receptacle or coupling member 22 which connects the lower section of casing 18 to an upper substantially non-electrically conductive casing section 24. The casing section 24 typically extends to the earth's surface and to a wellhead, generally designated by the numeral 26. Various configurations of wellhead may be used in accordance with the present invention and only a relatively simplified schematic form of wellhead is indicated in the drawing figures. Preferably the casing section 24 is of a substantially nonconductive material such as glass fiber or other filament reinforced of plastic. The casing section 24 may extend substantially the entire depth of the well except for the conductive casing section 18. Alternatively, those skilled in the art will recognize that vertically spaced apart casing sections 18 may be provided interposed between nonconductive casing sections when production from multiple vertically spaced formations is desired.

As illustrated in FIG. 1, the well 14 has been completed with the provision of a unique combination fluid conducting and electrical conductor tube shown disposed in working position and generally designated by the numeral 28. The tube 28 is of unique construction and is of a type which comprises a good electrical conductor having low hysteresis and eddy current characteristics, and is relatively thin-walled whereby the tube may be supplied for injection into the well 14 from a coiled tubing injector unit, illustrated in FIG. 1 and generally designated by the numeral 30. The injector unit 30 may be one of several types commercially available and provided in the form of a self-propelled truck type vehicle 32 on which is mounted a relatively large diameter reel 34 for storing a substantial length of tube 28 in coiled form. The tube 28 is typically uncoiled from the reel 34, propelled and straightened by an injector unit 36 through a lubricator or stuffing box 38 into the wellbore cavity 19 formed by the casing 18, 24.

As illustrated in FIG. 1, a lower portion of the tube 28 includes a connector member 38 which is both fluid and electrically conductive and is suitably connected to the lower end of the tube 28 at a point adjacent to the coupling 22. The connector member 38 is preferably provided with a suitable latching mechanism, generally designated by the numeral 42, for latching the tube 28 to the coupling 22. The connection formed between the connector member 38 and the coupling 22 may be characterized by a plurality of radially moveable latching dog members similar in construction to the type provided in casing packers and similar types of downhole well tools and which are radially movable into engagement with the coupling 22 at a recess 27. Electrical contact between the connector member 38 and the coupling 22 is also provided by a suitable contact pad member 44 provided on the connector member 38 and cooperating contact portions formed on the coupling member 22. Suffice it to say that an electrically conductive path is formed in the wellbore through the tube 28 including the connector member 38, the coupling 22 and the casing section 18. The upper and lower wellbore cavities are preferably sealed from each other by suitable seals 45 which are interactive between the coupling 22 and the connector 38.

As part of the well completion, the casing section 18 is suitably perforated at a plurality of perforation openings 50 which place the formation 10 in communication with the portion of the wellbore below the coupling 22. The tubing 28 is also illustrated in communication with a source of injection fluid, generally designated by the numeral 52, which may include a suitable pumping and treating facility for preparing and pumping an injection fluid, such as a brine solution, into the wellbore 23 and outward into the formation 10 through the perforation openings 50. The tubing 28 is also illustrated in communication with a source of electrical power such as a generator set 56. The generator set 56 typically, for remote operations, may include a gas turbine prime mover 58 driveably connected to an AC electrical power generator 60. The generator 60 is suitably coupled to the tubing 28 through a conductor 62 by way of suitable switchgear 64. The generator 60 is also coupled through a conductor 66 to the second well 16 in a manner to be described in further detail hereinbelow.

Referring further to FIG. 1, the well 16 also includes a casing comprising a lower casing section 68, similar to the casing section 18 and characterized by a cylindrical conductive metal tube which may be conventional steel casing tubing provided on its outer surface with an insulating layer 72 similar to the layer of insulation 20. A coupling member 22 is also connected to the casing section 68 and the insulation layer 72 extends over the coupling 22 in the same manner that the insulation 20 extends over the coupling member 22 in the arrangement of the well 14.

The well 16 further includes an electrically non-conductive casing section 76 which extends from the coupling 22 to a wellhead 78. The wellhead 78 comprises a head member 80 and a production fluid conduit 82 connected thereto for delivering production fluid from a wellbore cavity 21 to a suitable surface handling and treating facility, not shown. The well 16 has also been completed by perforation of the casing section 68 to provide a plurality of perforation openings 84, and with the insertion of an elongated flexible tube, generally designated by the numeral 86 into the wellbore cavity 25. The tube 86 is of substantially identical construction with respect to the tube 28 and has been preferably provided from a coiled tubing injection unit such as the injection unit 30. The lower end of the tubing 86 is coupled to a connector member 88 comprising an elongated tube which is suitably fitted at its upper end with a power oil pump of a suitable type generally designated by the numeral 90. Pump 90 may be a reciprocating power oil or power fluid type driven by the injection of hydraulic fluid down through the tube 86. Alternatively, the pump 90 may be of a jet or ejector type wherein power fluid is conducted down the tube 86 from a suitable source such as a pump 92 on the surface and the ejection of the power fluid at the member 88 educts well fluid from the wellbore 21 upwardly and within the annulur cavity 25 formed between the tube 86 and the casing section 76 and from the well 16 through the conduit 82. The connector member 88 is also provided with a suitable arrangement of latching members 89 which are operable to project radially outwardly to latching engagement with the coupling member 22. Electrical contact between the coupling 22 and the tube 86 is provided through a contact member 96 on the connector member 88 which is adapted to be in conductive engagement with the coupling member 22. The wellbore cavities 21 and 25 are preferably sealed from each other by suitable seal means 93 interactive between the pump 90 and the coupling 22.

The general arrangement illustrated in FIG. 1 thus provides an electrical circuit through the formation 10 wherein electric power is conducted from the generator 60 through conductors formed by the tubes 28 and 86, the respective connecmembers 38 and 88, the respective coupling members 22 and the casing sections 18 and 72. For example, the electrical path from the conductor 62 extends through the tube 28, the connector member 38, the coupling 22, the casing section 18 and a suitable conducting fluid such as brine which is injected into the wellbore cavity 23 and then through the perforation openings 50 into the formation 10. Permeation of the formation 10 by the conductive brine and the potential created between the electrodes formed by the casing sections 18 and 68 also results in a conductive path from the formation 10 through the casing section 68, the coupling 22 of well 16, the connector member 88, the tube 86 and finally, the conductor 66.

In the development of a well production system generally of the type illustrated in FIG. 1, the wells 14 and 16 would be drilled and the casing set in place in a substantially conventional manner. Completion procedures would follow substantially conventional practice with regard to the perforation of the casing sections 18 and 68 and the tubes 28 and 86 would be run into the respective wellbores 19 and 32 with their respective connector sections 38 and 88 connected thereto, utilizing the injector unit 30 or a similar type of tubing injector. Once the respective tubes 28 and 86 were latched in place with the respective couplings 22 in each of the wells 14 and 16, the tubes would be connected to their respective sources or receivers of fluid and to the generator set 56 using suitable insulating techniques to prevent electrical conduction in an unwanted direction. Stimulation of the formation 10 to produce flowable quantities of liquid hydrocarbons would be carried out by generating electrical power with the generator set 56 to establish current flow through the formation 10 and suitable heating of the viscous hydrocarbons therein. It is contemplated that generation of alternating current voltage potentials in the range of 550 to 1350 volts at 60 hertz and current ratings of 2000 to 2500 amperes would be suitable to produce flowable quantities of liquid hydrocarbons entering the wellbore 21 at a temperature in the range of about 400° F.

Thanks to the arrangement described here and illustrated in FIG. 1, several advantages are realized with respect to producing otherwise unrecoverable quantities of hydrocarbonaceous substances. The improved reeled or coiled tubing used for the tubes 28 and 86 permits the utilization of conventional coiled tubing injection equipment and wellhead components commonly used in crude oil production processes. The ability to continuously run in and retrieve the tubes 28 and 86 reduces the time and expense of conductor installation and servicing in wells, particularly in remote areas. Power fluid for hydraulic lift such as illustrated for the well 16 and the use of injection fluids such as treated water or brine, provides cooling of the tubes 28 and 86 to the extent that higher current densities may be carried for a given tube size. Heat rejected to the brine or other fluids in the injection well is beneficially used in heating the formation 10 as the fluid is injected thereinto.

Figure 2:
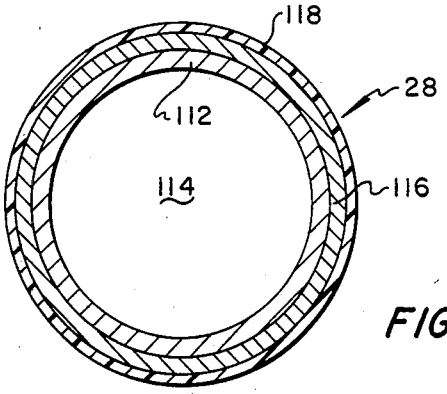
FIG. 2 is a transverse section view showing the construction of a combined fluid conductor and electrical conductor tube in accordance with the present invention.

Referring now to FIG. 2, there is illustrated a transverse cross section of a typical combined fluid conductor and electrical conductor tube such as the tube 28 or the tube 86. In accordance with the present invention, it is contemplated that steel tubing having nominal outside diameters of from 1 inch to 2.25 inches may be clad or wrapped with a layer of highly conductive metal such as copper in either a solid sheath or a braided wrap. Because of the harsh environment in which the tube is utilized, it is preferable to insulate the outer surface of the copper or other conductive metal layer with a coating of a suitable corrosion resistant plastic which may be reinforced with a fiber mat or wound filament.

The tubing cross section illustrated in FIG. 2 will be, for the sake of description, considered to be a cross section of the tube 28. The tube 28 is made up of a suitable alloy steel core portion 112 which defines an inner fluid flow passage 114. The steel core 112 is overwrapped or clad with a highly conductive copper layer 116 which may be solid continuous layer or may be a conductive wire braid, for example. In turn, the outer surface of the copper layer 116 is provided with a corrosion resistant coating 118 comprising a layer of a suitable plastic which, due to the bending and stress which the tube 28 undergoes during reeling and dereeling operations with respect to the injector unit 30, may be reinforced by a woven mat of glass fibers or by wound or wrapped filaments of glass fiber or other high strength nonconductive materials such as aramid fiber. In a typical tube having a nominal inside diameter of the steel core 112 of 2.06 inches, the outer diameter of the steel core would be 2.25 inches, the outer diameter of the copper layer 116 would be 2.50 inches and the outer diameter of the insulation layer 118 would be approximately 2.62 inches. Preliminary tests with tubing having the nominal dimensions indicated herein have been carried out indicating that the tubing may be reeled and dereeled from conventional oil field tubing injector equipment without determental effects.

Figure 3:
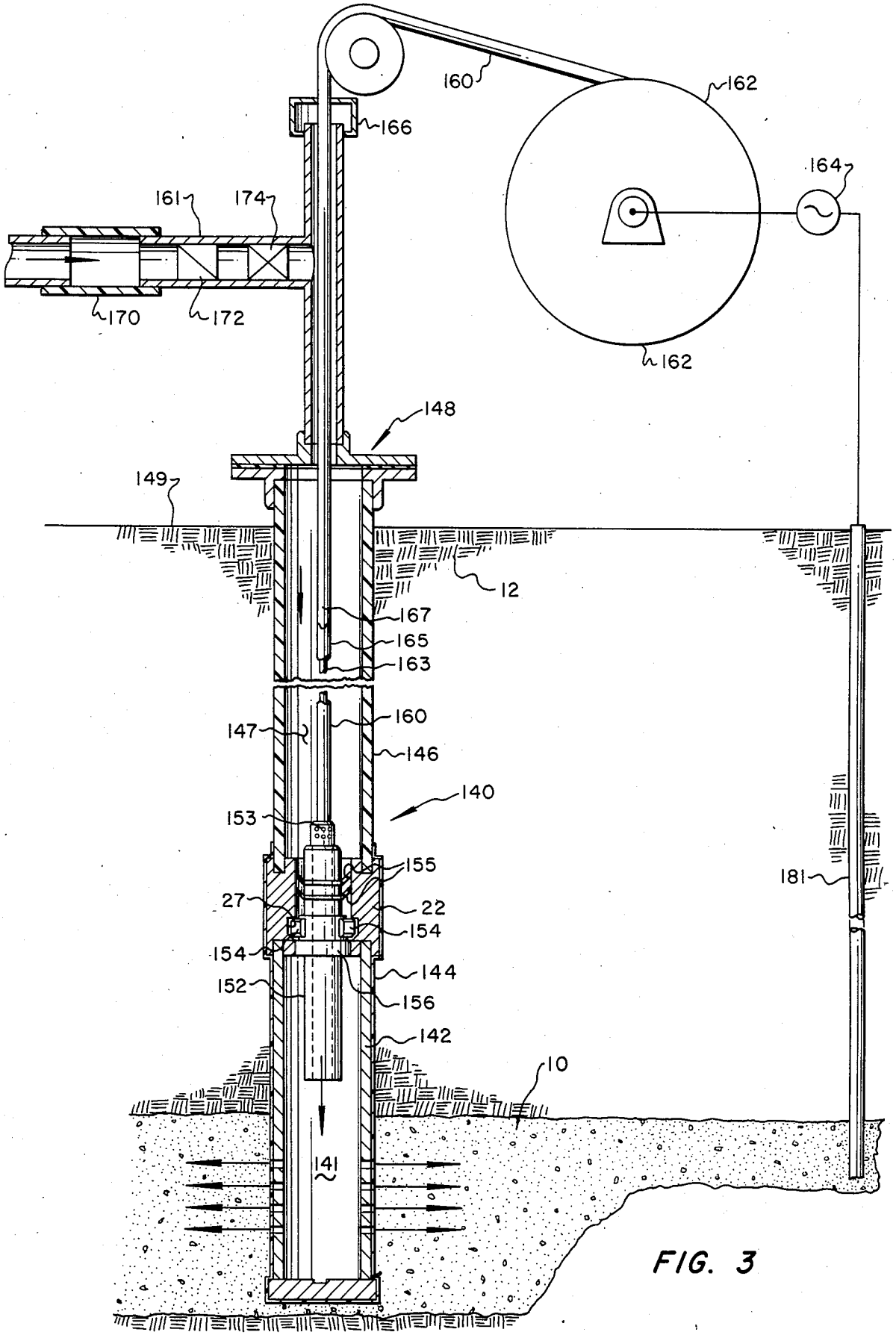
FIG. 3 is a schematic diagram of a well having an electrical and fluid conductor arrangement in accordance with a first alternate embodiment of the present invention.

Referring now to FIG. 3, an alternate embodiment of the present invention is illustrated in generally schematic form comprising a well 140 which has been drilled into a formation 10 for the purpose of producing viscous hydrocarbons through electrical heating of the formation. The well 140 is characterized by a lower conductive metal casing section 142 extending into the formation 10, a coupling member 22, and an outer insulative layer 144 covering the casing section 142 and the coupling 22. An upper casing section 146 extends to a wellhead 148 at the surface 149. The casing section 146 is preferably of a nonmetalic or nonconductive material such as glass fiber reinforced plastic or the like. The relative lengths of the casing sections 142 and 146 are similar to those described for the wells 14 and 16 or whatever demands are dictated by the well depth and formation thickness.

In the arrangement illustrated in FIG. 3, a conductive tube section in the form of a connector member 152 is adapted to be releasably coupled to the coupling 22 with a suitable arrangement of radially retractable latching members or dogs 154. A suitable contact pad or area of the connector member 152 is provided at 156 and is in electrically conductive engagement with the coupling 22 for transmitting current through the casing section 142.

Electrical current is transmitted to the tubing connector 152 through a flexible electrical cable 160 which is operable to be dereeled from a suitable cable reel 162 and may be connected to a suitable source of alternating current 164 through the cable reel by a slip ring arrangement, for example, not shown. The cable 160 is inserted into the wellbore 141 through conventional means, including a cable lubricator 166. The lower end of the cable 160 is connected to the connector member 152 in a suitable manner to provide conduction of electrical current from the cable to the connector member and, of course, then through the coupling 22 to the casing 142. The upper end of the connector 152 is provided with suitable fluid entry ports 153. A fluid seal is also formed between the connector 152 and the coupling 22, as indicated at 155.

A suitable injection fluid may be injected into the wellbore by way of a conduit 161 connected to the wellhead 148. A major portion of the conduit 161 is preferably suitably electrically insulated from the wellhead by a suitable insulating sleeve portion 170. A conventional check valve 172 and manually operated valve 174 are also provided in the conduit 161. The cable 160 includes a single conductor 163 and is preferably provided with an insulation layer 165, having a low friction coating 167 on the outer surface thereof.

Accordingly, with the system of the well 140, current is conducted through the flexible conductor 160 to the tubing connector 152, then to the coupling 22 and the casing section 142. By injecting a suitably conductive fluid, such as brine, into the wellbore section 147 through the conduit 161, this fluid may be forced downward in the wellbore through the entry ports 153 into the interior of the connector 152 and then into the lower wellbore portion 141 wherein a conductive path is provided into the formation 10 by way of the casing section 142 and the conductive brine solution. The conductive path may be completed through a conductor 181 or through a second well similar to the production well described and illustrated in FIG. 1. The well sytem illustrated in FIG. 3 also provides the advantages of a low power loss conductive path to the formation 10, injection fluid cooling of the electrical power conductor and transfer of the power that is lost to heat conversion on into the formation to enhance fluid recovery operations and to minimize the heat transfer to the earth structure surrounding the casing section 146.

Figure 4:
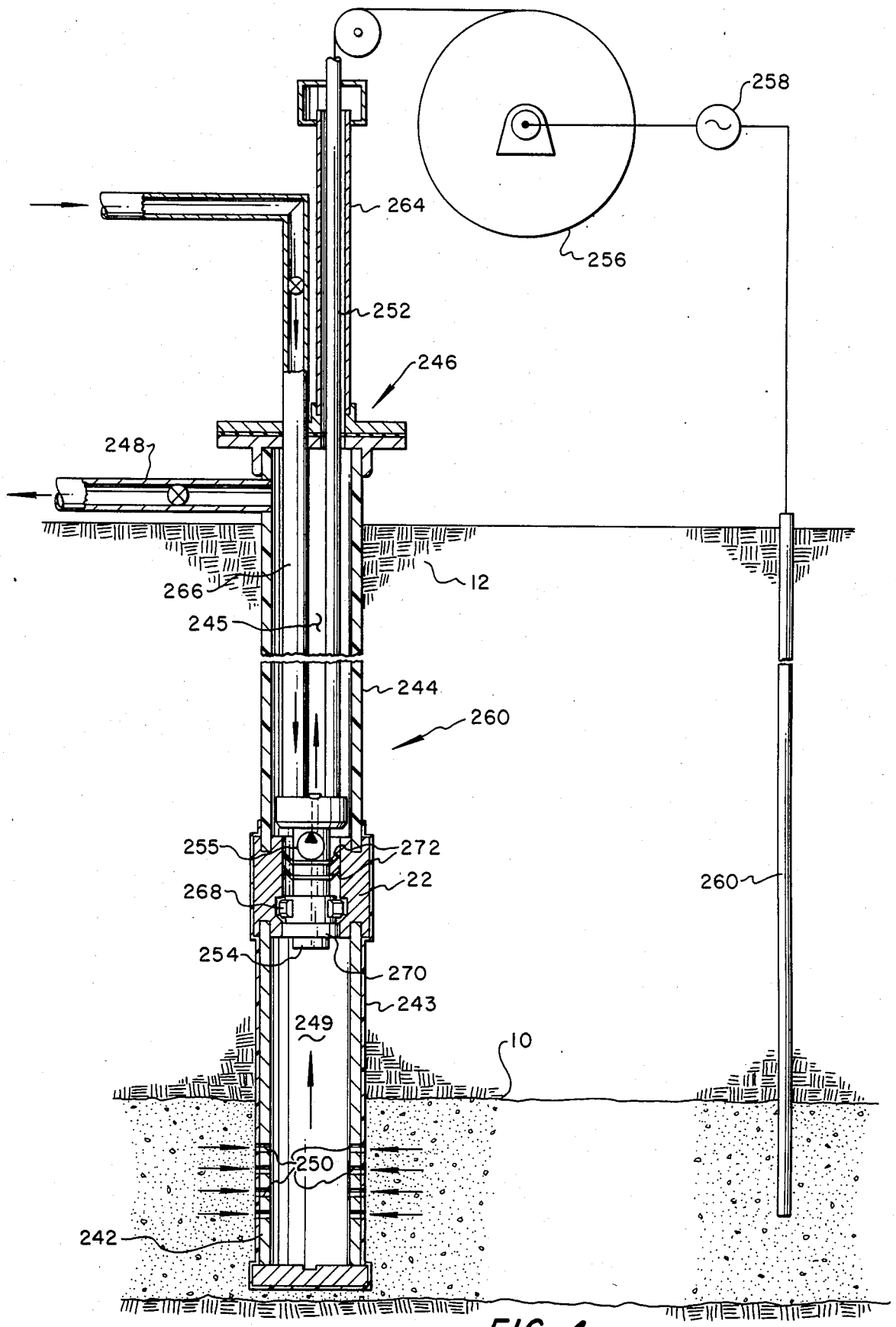
FIG. 4 is a schematic diagram of a well having an electrical and fluid conductor arrangement in accordance with a second alternate embodiment of the present invention.

Referring now to FIG. 4, there is illustrated yet another embodiment of the present invention, comprising a well 240 which has been drilled into a formation 10 and including a lower conductive casing section 242, a coupling 22, and an upper nonconductive casing section 244, extending to a wellhead 246. The casing section 242 and the coupling 22 are preferably covered with a layer of insulation 243. The well 240 is characterized as a production well and is adapted to provide for lifting produced fluid and power fluid through the wellbore 245 to a conduit 248. Formation fluids enter the lower wellbore 249 through perforation openings 250. In the arrangement illustrated in FIG. 4, a separate electrical power conductor cable 252 similar to the cable 160 extends downward to a combined electrical conductor and fluid conductor tubing section, generally designated by the numeral 254, and which may include a suitable power fluid driven pump 255 of the positive displacement or ejector type. The cable 252 is preferably supplied from a suitable reel 256 and is electrically connected to a source of electrical energy 258 which is also in communication with a conductor 260 to complete the conductive path formed by the stimulation circuits desribed herein. The conductor 260 may, of course, be part of another injection or production well similar to the well 240. The manner of inserting and supporting the cable 252 into the wellhead 246 may include a suitable lubricator structure 264 similar to the arrangement illustrated in FIG. 3. Injection fluid in the form of power oil or water may be conducted down to the member 254 through suitable uncoiled tubing 266.

The member 254 is mechanically coupled to the coupling 22 by a suitable arrangement of retractable latching members 268 and an electrically conductive path is provided between the coupling 22 and the tubing member 254 by way of a contact element 270. Suitable annular seal elements 272 may be provided between the member 254 and the coupling 22 to form a fluid seal between the wellbore sections 245 and 249, except through the fluid path formed within the member 254.

In operation, the system illustrated in FIG. 4, is operable to produce fluids from the formation 10 by resistance heating of the formation through the conductive path formed between the conductor 260, the formation structure 10, the produced fluid, the casing section 242, the coupling 22, the contact element 270, the member 254 and the cable 252, which is electrically connected to the source 258 by way of the reel 256, for example. Accordingly, a fluid conductive member such as the member 254 is also adapted to form an electrically conductive path or portion therof. Fluid is stimulated to flow from the formation 10 into the wellbore portion 249 wherein it can be lifted through the wellbore portion 245 by pumping action through the injection of power fluid through the tubing 266 down the pump 255 disposed within the member 254 whereby production fluid is transferred from the wellbore portion 249 to the wellbore portion 245 and lifted for removal from the well through the conduit 248. Production of fluid from the formation 10 by the utilization of a power oil or other form of power fluid reduces the temperature of the lifted fluid and also provides cooling of the member 254 and the cable 252 as may be required due to resistence heating losses in these members.

It will be appreciated from the foregoing that a unique system has been provided for producing relatively viscous fluids from subterranean formations using electrical resistance heating wherein at least a portion of the electrical conductor structure is also a fluid conducting member for conducting fluids from a wellbore toward the earth's surface. Although preferred embodiments of the invention have been describe in detail herein, those skilled in the art will recognize that various substitutions and modifications may be made to the specific embodiments described and shown without departing from the scope and spirit of the invention as recited in the appended claims.

What is claimed is:

1. In a well system for producing fluids from a subterranean formation, casing means forming a first wellbore to provide for conducting fluids between a point on the earth's surface and said formation, said casing means including a first casing section formed of electrically conductive material and extending within a zone of said formation through which fluids are to be conducted between said formation and said first wellbore, a coupling member disposed in said first wellbore and connected to said first casing section for conducting electric current between said coupling member and said first casing section, an elongated electrically conductive tube extending within said casing means from said surface to said coupling member for conducting fluid between said surface and said formation through a cavity formed in said first wellbore by said first casing section, said tube including means cooperable with said coupling member to mechanically and electrically connect said tube to said coupling member for conducting electric current between a source of electric energy and said formation through said coupling member and said tube.

2. The well system set forth in claim 1, wherein:
said first casing section includes insulation material disposed on the outer surface thereof for insulating said casing section from said formation.

3. The well system set forth in claim 1, wherein:
said casing means includes a second casing section extending from said coupling member toward said surface and being formed of a substantially electrically nonconductive material.

4. The well system set forth in claim 1, including:
pump means in said first wellbore and connected to said tube, a source of pressure fluid connected to said tube and operable to cause said pump means to pump well fluids from said first wellbore toward said surface.

5. The well system set forth in claim 1, including:
a second wellbore disposed at a point spaced from said first wellbore and extending into said formation, tubing means extending in said second wellbore and comprising a portion of an electrically conductive path from said source and through said first wellbore, said formation, and said second wellbore.

6. The well system set forth in claim 1, wherein:
said tube includes a first cylindrical section comprising an elongated steel tube, a second cylindrical section coaxial with said first cylindrical section and comprising an elongated copper tube and an outer protective coating for said tube.

7. The well system set forth in claim 6, wherein:
said coating comprises a reinforced plastic material.

8. In a well system for producing fluids from a subterranean formation by electrically heating said formation to stimulate the flow of said fluids therethrough, casing means forming a wellbore and including an electrically conductive casing section extending within a zone in said formation, a generally cylindrical coupling member forming a receptacle and in electrically conductive engagement with said casing section, a connector member adapted to be disposed in said wellbore and engaged with said coupling member, said connector member being connected to elongated electrical conductor means extending from said connector member to a source of electrical energy for conductor current between said source and said formation through said connector member and said coupling member, at least a portion of said connector member including fluid conducting means extending within said casing means for conducting fluids through said wellbore.

9. The well system set forth in claim 8, wherein:
said casing means includes a substantially non-electrically conductive casing section extending between said coupling member and the earth's surface above said formation.

10. The well system set forth in claim 8, wherein:
said conductor means includes an elongated coilable metal tube extending between said connector member and said source.

11. The well system set forth in claim 10, wherein:
said tube includes a first cylindrical section comprising an elongated steel tube, a second cylindrical section coaxial with said first cylindrical section and comprising a copper conductor, and an outer lyaer of protective insulation.

12. The well system set forth in claim 8, wherein:
said conductor means includes an elongated electrical cable extending between the earth's surface and said connector 13. The well system set forth in claim 12, wherein:
said connector member includes a pumping unit disposed in said wellbore and connected to an elongated fluid conducting tube and to an elongated electrical cable extending from said surface and comprising part of said conductor means.

14. In a well system for producing fluids from a subterranean formation, casing means forming a wellbore to provide for conducting fluids between a point on the earth's surface and said formation, a coupling member disposed in said wellbore and connected to said casing means, an elongated tube extending within said casing means from said surface to said coupling member for conducting fluid between said surface and said formation, said tube including means cooperable with said coupling member to mechanially and electrically connect said tube to said coupling member for conducting electric current between a source of electric energy and said formation through said coupling member and said tube, said tube comprising the combination of a steel tube section, an outer copper conductor section disposed over said steel tube section, and a protective coating over said copper conductor section so as to provide for reduced hysteresis losses together with heat exchange between said tube and fluid flowing through said tube.

15. In a well system for producing fluids from a subterranean formation, casing means forming a wellbore to provide for conducting fluids between a point on the earth's surface and said formation, a coupling member disposed in said wellbore and connected to said casing means, an electrically conductive tube extending within said casing means and connected to said coupling member for conducting fluid between said surface and said formation through a cavity formed in said wellbore, said tube including means cooperable with said coupling member to mechanically and electrically connect said tube to said coupling member for conducting electric current between a source of electric energy and said formation through said coupling member and said tube, a fluid pumping unit disposed in said wellbore and connected to said tube for pumping fluids out of said wellbore through said tube, and conductor means electrically connected to said tube for conducting electric current between the earth's surface and said formation through said tube.

* * * * *

UNITED STATES PATENT OFFICE

CERTIFICATE OF CORRECTION

PATENT NO. : 4,662,437

DATED : May 5, 1987

INVENTOR(S) : Jimmie J. Renfro

It is certified that error appears in the above-identified patent and that said Letters Patent are hereby corrected as shown below:

Column 9, line 67, "conductor" should read ---conducting---.

Column 10, line 18, "lyaer" should read ---layer---.

Column 10, line 23, after "connector" insert ---member.---

Signed and Sealed this

Fourth Day of April, 1989

*Attest:*

*Attesting Officer*

DONALD J. QUIGG

*Commissioner of Patents and Trademarks*